US009433252B2

(12) United States Patent
Lebel et al.

(10) Patent No.: US 9,433,252 B2
(45) Date of Patent: Sep. 6, 2016

(54) HELMET ACCESSORY ATTACHMENT SYSTEM

(75) Inventors: Stéphane Lebel, St. Redempteur (CA); Dominic Giroux Bernier, Montreal (CA); Michael James McGinn, Montreal (CA)

(73) Assignee: Revision Military S.ar.L., Luxembourg (LU)

( * ) Notice: Subject to any disclaimer, the term of this patent is extended or adjusted under 35 U.S.C. 154(b) by 478 days.

(21) Appl. No.: 13/563,584

(22) Filed: Jul. 31, 2012

(65) Prior Publication Data

US 2014/0033406 A1 Feb. 6, 2014

(51) Int. Cl.

| | |
|---|---|
| ***A42B 3/04*** | (2006.01) |
| ***A42B 3/22*** | (2006.01) |
| ***A42B 3/32*** | (2006.01) |

(52) U.S. Cl.

CPC ..... *A42B 3/04* (2013.01); *A42B 3/221* (2013.01); *A42B 3/326* (2013.01)

(58) Field of Classification Search

CPC ..... A42B 3/228; A42B 3/221; A42B 3/222; A42B 3/04; A42B 3/223; A42B 3/326; A42B 3/00; A42B 3/18; A42B 3/205; A42B 3/20

USPC ..... 2/422

See application file for complete search history.

(56) References Cited

U.S. PATENT DOCUMENTS 4,042,974 A 8/1977 Morgan et al.
4,199,823 A * 4/1980 Jenkins et al. ..... 2/424
4,224,694 A * 9/1980 Palmaer ..... A42B 3/04 2/422
4,536,892 A 8/1985 Brinkhoff et al.
4,769,857 A 9/1988 Cianfanelli et al.
5,165,117 A * 11/1992 Kamata ..... 2/424
5,297,297 A * 3/1994 Pei ..... 2/424

(Continued)

FOREIGN PATENT DOCUMENTS

DE 10234330 A1 * 2/2004 ..... A42B 3/32
EP 0 080 202 A2 6/1983

(Continued)

OTHER PUBLICATIONS

International Search Report and Written Opinion for International Application No. PCT/IB2013/002072 mailed Jan. 17, 2014.

*Primary Examiner* — Khoa Huynh
*Assistant Examiner* — Megan Brandon
(74) *Attorney, Agent, or Firm* — Wolf, Greenfield & Sacks, P.C.

(57) ABSTRACT

A helmet accessory attachment system may include an attachment portion comprising a biasing element, a position member, and a movable member. The movable member may be selectively moveable between a home position which is a first distance from the position member and a release position which is a second distance from the position member. The biasing element may bias the movable member toward the home position. The helmet accessory attachment system also may include a mounting portion attachable to a helmet. The mounting portion may include a first channel to receive the movable member at a first opening and a second channel to receive the position member at a second opening. A third distance between the first opening of the first channel and the second opening of the second channel may be greater than the first distance from the movable member to the position member in the home position.

43 Claims, 15 Drawing Sheets

(56) References Cited

U.S. PATENT DOCUMENTS

| | | | | |
|---|---|---|---|---|
| 5,603,117 | A | 2/1997 | Hudner et al. | |
| 5,752,280 | A * | 5/1998 | Hill | A42B 3/185 2/453 |
| 5,966,738 | A * | 10/1999 | Wang Lee | 2/10 |
| 7,219,370 | B1 * | 5/2007 | Teetzel et al. | 2/6.2 |
| 8,286,270 | B2 * | 10/2012 | Higgins | A42B 3/185 2/15 |
| 8,677,517 | B1 * | 3/2014 | Morency et al. | 2/424 |
| 2002/0129440 | A1 * | 9/2002 | Hong et al. | 2/422 |
| 2003/0182716 | A1 * | 10/2003 | Wu | 2/424 |
| 2006/0064799 | A1 * | 3/2006 | Dion | 2/424 |
| 2006/0282939 | A1 * | 12/2006 | Rogers et al. | 2/422 |
| 2008/0216215 | A1 * | 9/2008 | Lee | 2/424 |
| 2009/0144872 | A1 * | 6/2009 | Lebel et al. | 2/6.7 |
| 2009/0183302 | A1 * | 7/2009 | Choi | 2/424 |
| 2009/0307826 | A1 * | 12/2009 | Rogers et al. | 2/422 |
| 2010/0050326 | A1 * | 3/2010 | Lee | 2/422 |
| 2011/0113519 | A1 * | 5/2011 | Gendron et al. | 2/2.5 |
| 2011/0113535 | A1 | 5/2011 | Lebel et al. | |
| 2011/0239354 | A1 * | 10/2011 | Celona et al. | 2/422 |
| 2011/0302701 | A1 * | 12/2011 | Kuo | 2/421 |
| 2011/0307990 | A1 | 12/2011 | Croteau et al. | |
| 2011/0314594 | A1 * | 12/2011 | Rogers et al. | 2/421 |
| 2012/0117717 | A1 * | 5/2012 | McGinn et al. | 2/424 |
| 2012/0204331 | A1 | 8/2012 | Lebel et al. | |
| 2012/0317706 | A1 * | 12/2012 | Lebel et al. | 2/422 |
| 2013/0191976 | A1 * | 8/2013 | Pizzi | 2/424 |
| 2013/0291290 | A1 * | 11/2013 | Bernier et al. | 2/422 |
| 2013/0318691 | A1 * | 12/2013 | Krick et al. | 2/425 |
| 2014/0075654 | A1 * | 3/2014 | McGinn et al. | 2/422 |

FOREIGN PATENT DOCUMENTS

| | | | |
|---|---|---|---|
| EP | 1 834535 | A2 | 9/2007 |
| FR | 2677604 | A1 | 12/1992 |
| WO | WO 2011101722 | A1 * | 8/2011 |

* cited by examiner

HELMET ACCESSORY ATTACHMENT SYSTEM

FEDERALLY SPONSORED RESEARCH

This invention was made with government support under W911QY-11-C-0042 awarded by the Department of Defense. The government has certain rights in the invention.

FIELD OF THE INVENTION

The present invention relates to helmet accessory attachment systems.

DISCUSSION OF THE RELATED ART

Soldiers, first responders, law enforcement officers, sports participants, and others wear protective headgear such as a helmet. Such a helmet may mount various accessories to aid and/or protect the helmet wearer for a specific activity or environment.

SUMMARY

In one embodiment, a helmet accessory attachment system includes an attachment portion comprising a biasing element, a position member, and a movable member. The movable member is selectively moveable between a home position which is a first distance from the position member and a release position which is a second distance from the position member. The biasing element biases the movable member toward the home position. The helmet accessory attachment system also includes a mounting portion attachable to a helmet. The mounting portion comprises a first channel to receive the movable member at a first opening and a second channel to receive the position member at a second opening. A third distance between the first opening of the first channel and the second opening of the second channel is greater than the first distance from the movable member to the position member in the home position.

In another embodiment, a helmet accessory attachment system includes an attachment portion comprising a biasing element, a position member, and a movable member. The movable member is selectively moveable between a home position and a release position. The biasing element biases the movable member toward the home position. The helmet accessory attachment system also includes a mounting portion attachable to a helmet. The mounting portion comprises a first channel to receive the movable member, and a second channel to retain the position member when the movable member is in the home position and release the position member when the movable member is in the release position.

In yet another embodiment, a method for removably attaching an accessory to a helmet is disclosed. The method includes: providing an attachment portion comprising a biasing element, a position member, and a movable member selectively moveable between a home position and a release position, wherein the biasing element biases the movable member toward the home position; sliding the movable member into a first channel of a mounting portion; moving the movable member to the release position; rotating the attachment portion to align the position member with a second channel of the mounting portion; and releasing the attachment portion such that the position member is drawn into the second channel of the mounting portion as the movable member returns to the home position.

In another embodiment, a helmet accessory attachment system includes an accessory and an attachment portion attachable to the accessory. The attachment portion includes a biasing element, a position member, and a movable member. The movable member is selectively movable between a home position and a release position. The biasing element biases the movable member toward the home position. The position member is retained in a channel of the mounting portion when the movable member is in the home position and released from the channel of the mounting portion with a movable member is in the release position.

It should be appreciated that the foregoing concepts, and additional concepts discussed below, may be arranged in any suitable combination, as the present disclosure is not limited in this respect.

The foregoing and other aspects, embodiments, and features of the present teachings can be more fully understood from the following description in conjunction with the accompanying drawings.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1:
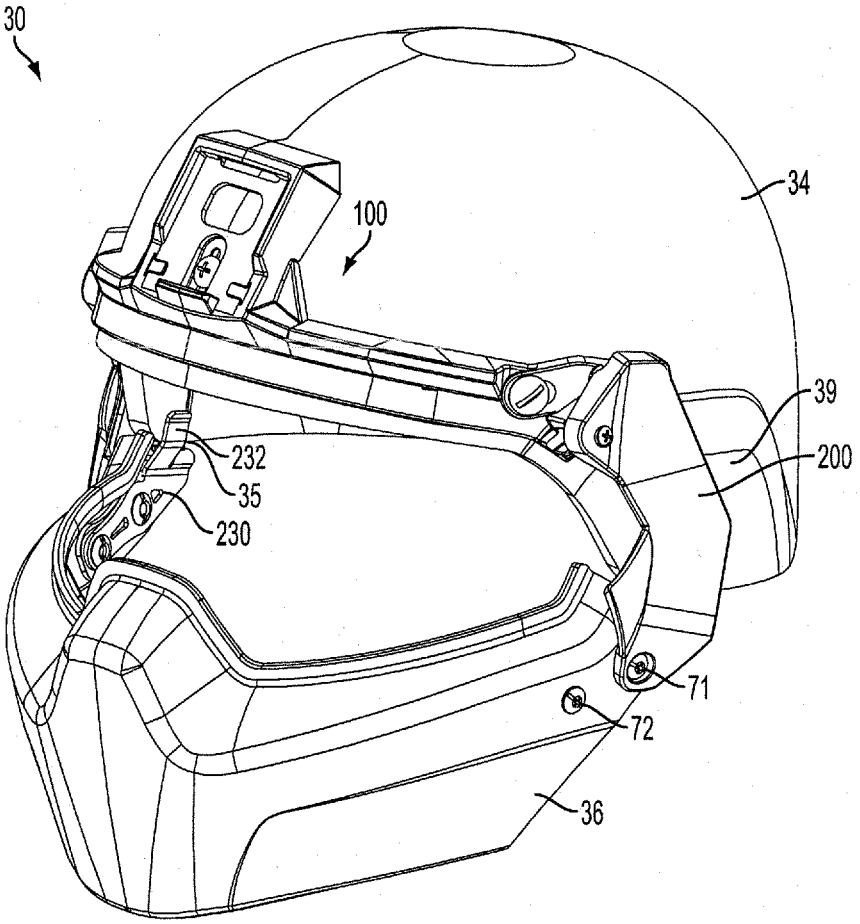
FIG. 1 is a perspective view of a helmet assembly outfitted with a helmet accessory attachment system.

The applicant has recognized that current helmet accessory attachment systems can be improved in terms of the ease and speed of the selective attachment of accessories. The applicant has recognized that an accessory attachment and removal system that does not require straps, bolts, buckles, and/or other time consuming attachment mechanisms can be advantageous in various arrangements. Of course, straps, bolts and buckles may be used with embodiments disclosed herein in various capacities.

Such a system may be of use for attaching accessories such as an illuminator, a camera, a video recorder, a laser pointer, a communications component, an IFF device, an attachment arm, a visor, a face shield, goggles, and/or a mandible guard to a helmet. Such a system may be of particular use in providing a selectively attachable mandible guard to provide full face protection as might be desired for applications such as motorcycle helmets, combat helmets, and other applications. For example, in certain situations, a soldier may desire to have a combat helmet without a protective face shield due to factors such as weight, heat, and other suitable considerations. However, if the soldier were in a combat situation, the solider may wish to add facial protection to the helmet. The helmet accessory attachment systems disclosed herein provides the wearer with the capability to quickly and easily reconfigure the accessories attached to their helmets to adapt to different needs, conditions, and other mission/activity specific demands.

The helmet accessory attachment systems disclosed herein include an attachment portion and a mounting portion. The attachment portion and mounting portion include components arranged and configured to selectively attach with one another. Specifically, in some embodiments, the attachment portion includes a position member and a movable member spaced from the position member. In some instances, the movable member is a slide member. For the sake of clarity, the embodiments described herein include a slide member, though other configurations of the movable member are contemplated.

The position member and slide member are arranged to be positioned and retained in corresponding channels located on the mounting portion. For example, the position member and slide member may comprise features that engage with the corresponding channels while permitting the position member and slide member to slide therein. The above noted channels do not have to have a length that is longer than a corresponding movable member. Instead, for purposes herein, the term channel should be interpreted broadly as encompassing any structure including an opening and receiving area capable of retaining a movable member when a biasing force is applied thereto. For example, this would include a semicircular, triangular, or any other suitably shaped recess or cutout sized to accept and retain a portion of the movable member's outer periphery.

In addition to the above, the slide member is selectively movable relative to the position member between a home position and a release position. The slide member may include any suitable structure including, for example, a pin and slot, a linear bearing, a linkage, a journal bearing, or any other suitable mechanism. In certain embodiments, the slide member is biased to the home position by a biasing element such as a spring, a resilient ring such as an O-ring, a magnet, or other suitable device capable of applying a force to the slide member. In one embodiment, the resilient ring is an elastomeric ring with material properties and dimensions selected to provide a desired biasing force to the slide member. Alternatively, the resilient ring also may comprise a coil spring arranged in a ring.

When it is desired to attach the attachment portion to the mounting portion such that an accessory becomes mounted to a helmet, a user positions the slide member of the attachment portion in a first of the corresponding channels on the mounting portion. The slide member then is selectively moved toward the release position while positioned in the first corresponding channel. The attachment portion is subsequently pivoted relative to the mounting portion until the position member is aligned with the second corresponding channel on the mounting portion. In some embodiments, this pivoting of the attachment portion comprises a pivoting around the slide member. Once aligned, the user releases the attachment portion. Due to the biasing element, the slide member is urged toward the home position, thus drawing the position member into the second channel and securing the attachment portion to the mounting portion. To remove the attachment portion from the mounting portion, the user pulls the position member out of the second channel, pivots the attachment portion such that the position member is not aligned with the second channel, and then removes the slide member from the first channel. In some embodiments, this system permits a user to attach and remove the accessory attachment portion from the mounting portion using a single hand.

The helmet accessory attachment system is mounted to the helmet via the mounting portion. The mounting portion may be mounted to the helmet, either directly, or indirectly via other components associated with the helmet. For example, in certain embodiments, the helmet may include a rail extending about some or all of the helmet outer shell and the mounting portion may be mounted to such a rail. Additionally, the mounting portion may be shaped, if desired, to complement a shape of the helmet if directly mounted thereto. Or the mounting portion may complement a shape of a component, such as the above noted rail, when indirectly mounted to the helmet. The mounting portion may be permanently or removably mounted to the helmet. The fixation component or medium for mounting the mounting portion to the helmet may be dedicated to the accessory attachment system or it may be multi-functional. Regarding the latter embodiment, a fastener that extends through a helmet shell to secure an internal suspension system, a chin-strap, or other component might also be employed to secure the mounting portion to the helmet. Alternatively, a fastener dedicated exclusively to the mounting portion may be used. Non-hardware fastening arrangements for mounting the accessory attachment system to a helmet are also contemplated including, without limitation, adhesive arrangements and hook and loop fastening systems.

For clarity, the mounting portion has been described as being attached directly, or indirectly, to a helmet. However, in some embodiments, a component may be directly attached to the helmet and include the features described for the attachment portion and still be considered to be the attachment portion. Similarly, a component may be selectively attachable to a component attached to the helmet and include the features described for the mounting portion and still be considered to be the mounting portion. For example, in one embodiment, the attachment portion is attachable to the helmet and includes the disclosed slide member, position member, and biasing element. Further, the corresponding mounting portion includes an accessory attachment portion and is selectively attachable to the attachment portion attached to the helmet via corresponding support and position channels disposed thereon.

As noted above, the helmet accessory attachment system is configured to selectively retain at least one accessory. The helmet accessory may include, but is not limited to, an illuminator, a camera, a video recorder, a laser pointer, a communications component, an IFF device, an attachment arm, a visor, a face shield, goggles, a mandible guard, and/or any other item suitable for carriage by a helmet or as may be dictated by a mission/activity specific requirement. The accessory attachment system is not limited necessarily to any particular arrangement for mounting the specific accessory. For example, a rail-type system may be used to attach an accessory, including a standard military mounting system such as the Picatinny rail system. Alternatively, the helmet accessory attachment system may be configured to mount an accessory via a bolted connection, a hook and loop fastener, a magnetic connection, interlocking features, and any other suitable arrangement. In some embodiments, the accessory may be indirectly attached to the attachment portion. For instance, the accessory may be mounted on an attachment arm connected to the attachment portion. Further, depending upon the specific accessory, the accessory may be attached to either one attachment portion or a plurality of attachment portions for mounting to a helmet.

While any number of arrangements are possible, for the sake of clarity, the current disclosure is limited to describing a helmet accessory attachment system for selectively attaching a mandible guard to a helmet. Therefore, even though a single type of accessory is described below, the current disclosure should be viewed generally as teaching a helmet accessory attachment system that could be used for attaching any number of different accessories. Further, the current disclosure is not limited to any single embodiment and includes variations incorporating combinations of features disclosed in the various different embodiments. Additionally, it should be noted that the helmet assembly described herein may be symmetrical across a vertical, front-to-back center plane 28 as shown by the figures. Consequently, any description of a component on one side of the helmet is also applicable to the corresponding component on the other side of the helmet. Though of course in some embodiments, asymmetric helmets and/or mounting arrangements may be use.

Figure 2:
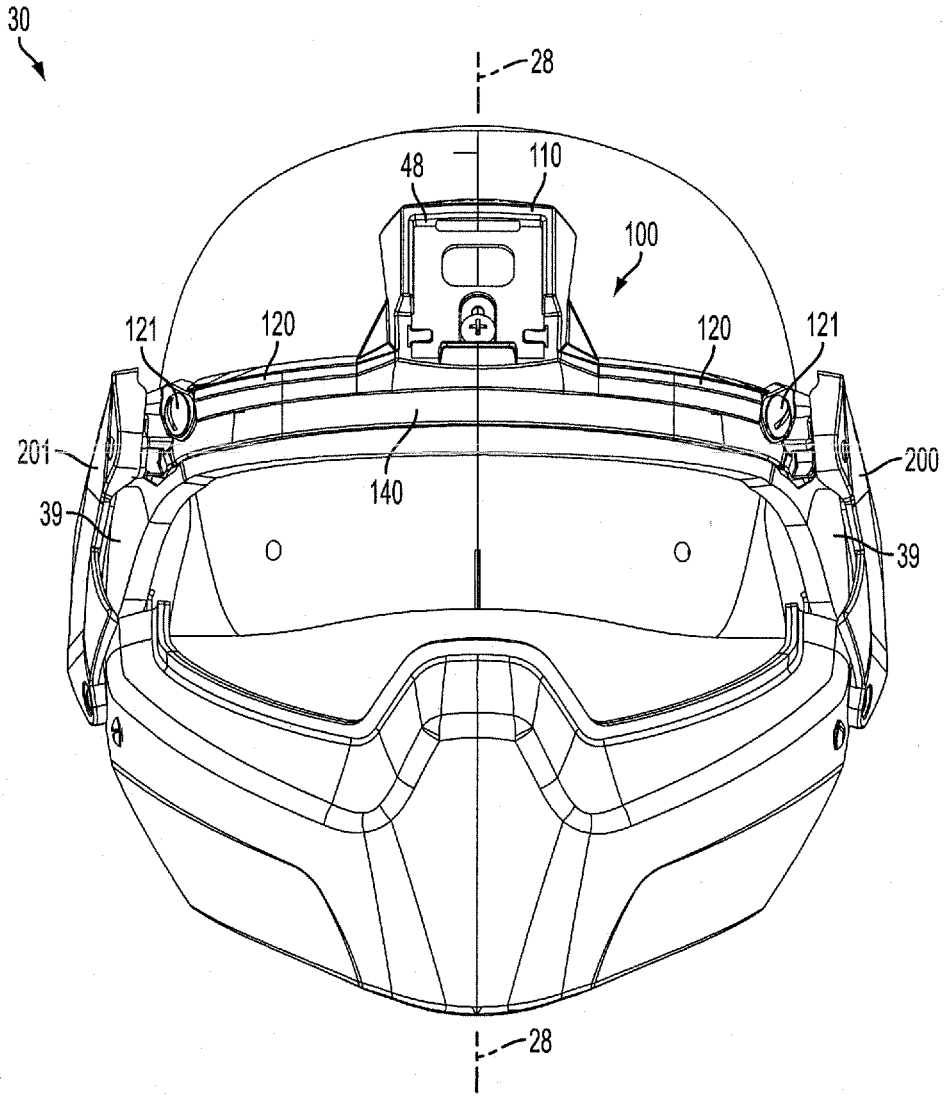
FIG. 2 is a front view of the helmet assembly of FIG. 1.
Figure 3:
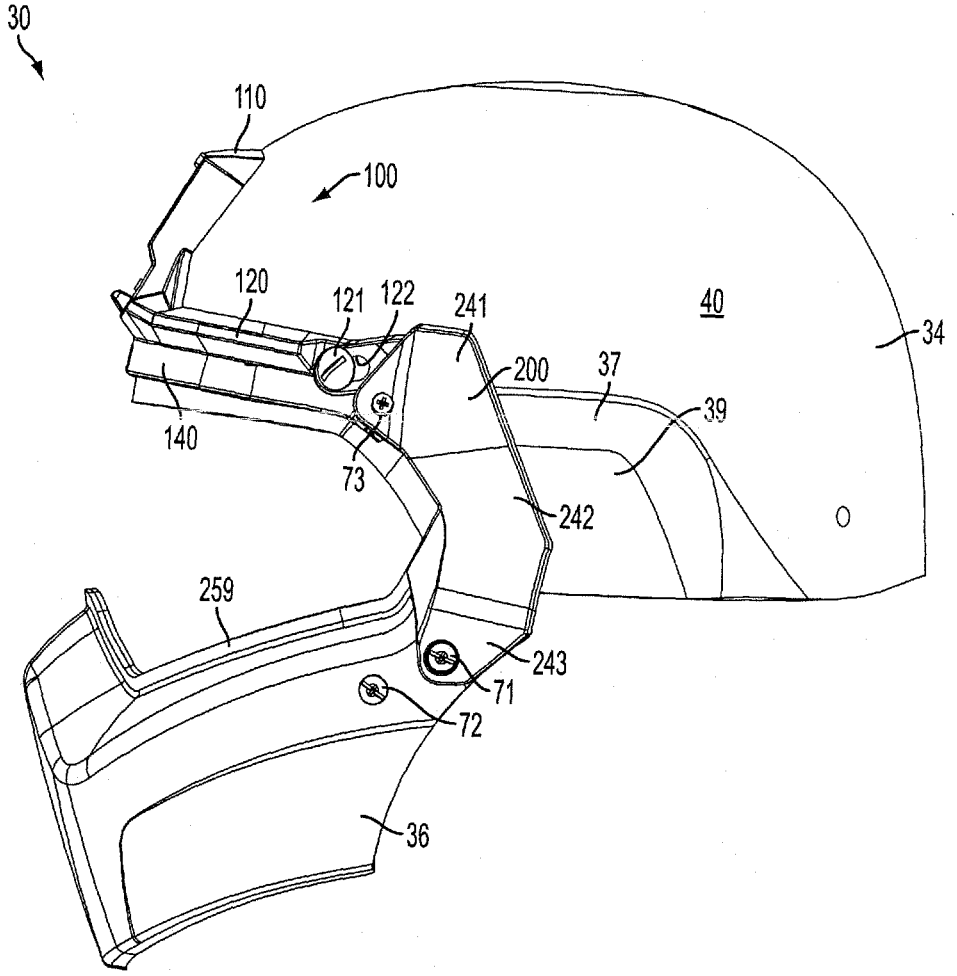
FIG. 3 is a right side view of the helmet assembly of FIG. 1.

Turning now to the figures, FIGS. 1-3 illustrate an embodiment of a helmet assembly 30 to be worn by a wearer (not shown) incorporating one embodiment of a helmet accessory attachment system. The helmet assembly includes a helmet, such as a military helmet 34 and a mandible guard 36 operatively connected to the helmet 34. In some embodiments, a protective face shield (not shown), such as a transparent visor or transparent face shield, is operatively connected to the helmet substantially between a front of the helmet 34 and the mandible guard 36. The face shield may be mounted to the helmet using any appropriate mounting arrangement including central accessory mount 110 as described in U.S. patent application Ser. No. 13/101,320, which application is herein incorporated by reference to the extent not inconsistent with the present description. Alternatively, the protective face shield may be mounted to the helmet via the currently disclosed helmet accessory attachment system. In other embodiments, mandible guard 36 is a unitary structure and may include an upstanding rim 259 that provides a surface against which the face shield, or lenses, can be supported. In some embodiments, the mandible guard may be any of the constructions disclosed in U.S. patent application Ser. No. 13/101,320.

In some embodiments, the helmet accessory attachment system includes a helmet rail 100 that selectively attaches with the left and right attachment arms 200 and 201. The helmet rail 100 extends across at least a partial width of the helmet and is positioned over a face opening of the helmet 34 between right and left ear cups 39, and in some embodiments, over a portion of the ear cup area. The helmet rail 100 includes support channels 150 adjacent each lateral end of the helmet rail 100 corresponding to two separate mounting portions for selectively attaching the mandible guard 36 to the helmet via the left and right attachment arms 200 and 201. The mandible guard 36 is fastened to the attachment arms 200 and 201 by two bolts 71 and 72. Position members, corresponding to position bosses 215, engage position channels 130 in the helmet rail 100 to prevent upward motion of the mandible guard when in an attached position. The attachment arms 200 and 201 also may engage the helmet edge 35 to provide additional support to the mandible guard.

The helmet rail 100 is shown in detail in FIGS. 1-4D. As depicted in the figures, the helmet rail 100 includes the top front formation or central accessory mount 110 that includes an inverted U-shaped retainer portion 48. Further, the helmet rail includes two upper rail segments 120 that flank the top front formation or central accessory mount 110. The mount also includes the bottom rail portion 140 that extends under the upper rail segments 120 and under the top front formation or central accessory mount 110. Mounting slots 122 are located at opposite end areas of the helmet mount 100 adjacent the ear cups. The mounting slots allow helmet rail 100 to be connected to the front area of a helmet as shown in FIGS. 1-3 by fasteners, such as bolts 121.

Figure 4B:
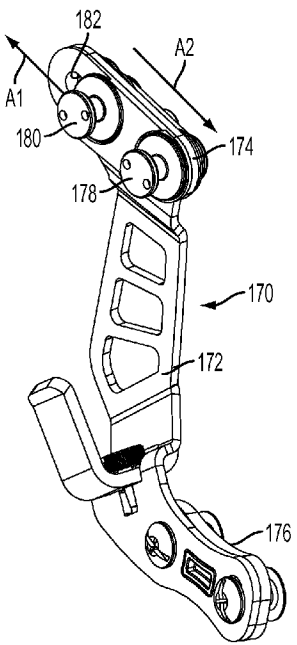
FIG. 4B is an interior perspective view of an attachment arm.
Figure 4A:
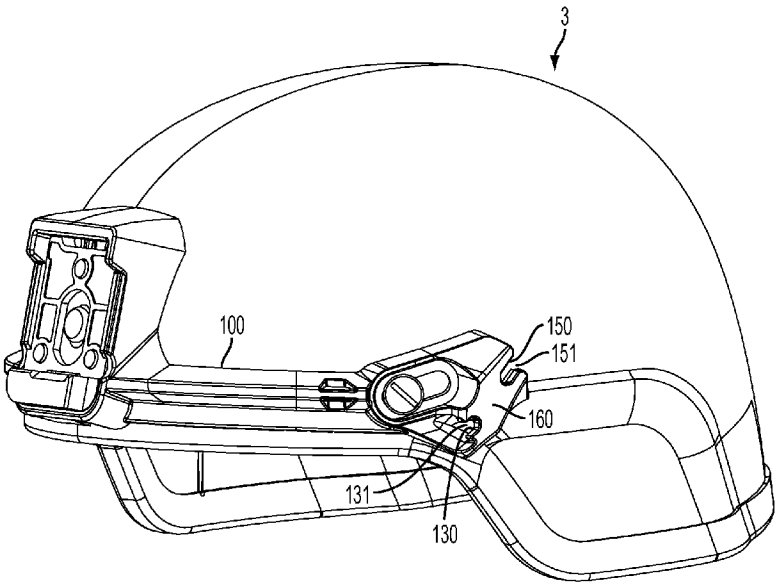
FIG. 4A is a perspective view of a helmet assembly and attached mounting portion.

FIGS. 4A and 4B depict a helmet incorporating the above noted helmet rail 100 and an associated attachment arm 170 in an unattached state. The attachment arm 170 includes a base plate 172. The base plate includes an attachment portion 174 and an accessory retention portion 176. The accessory retention portion 176 may be configured in any suitable manner as noted above to selectively, or permanently, retain an accessory. The attachment portion 174 is configured to be selectively attachable to a mounting portion 160 associated with helmet rail 100. While mounting portion 160, as depicted in the figures, is operatively coupled with helmet rail 100, it could be integrally formed with or attached to helmet 34 directly. The mounting portion 160 includes a position channel 130 and support channel 150. The attachment portion 174 includes corresponding position member 178 and a movable member embodied as slide member 180. The slide member 180 and position member 178 are configured to slide in the channels on the mounting portion while being retained therein. As depicted in the figures, slide member 180 and position member 178 may be pins with retention features configured to retain the members within the corresponding channels. Alternatively, in some embodiments, position member 178 may be a boss, protrusion, or any other suitable construction that may be slidingly retained in the corresponding channel. As described in more detail below, the attachment portion and mounting portion are configured to be selectively attachable to one another by the selective positioning of slide member 180 in support channel 150 and position member 178 in position channel 130.

While specific embodiments of the slide member 180 and position number 178 are depicted herein, any suitable arrangement capable of retaining the sliding member 180 and position member 178 within the corresponding channels while permitting the desired selective attachment is contemplated as being part of the present disclosure.

In the depicted embodiment, the position member 178 is fixedly attached to the attachment portion 174 such that it is stationary relative to the attachment portion during operation. On the other hand, the slide member 180 is slidingly retained within a slot 182 on the attachment portion such that it is selectively movable in a direction A1 between a home position and a release position. In certain embodiments, slide member 180 is held stationary relative to the mounting portion on the helmet during attachment of the attachment and mounting portions. In such embodiments, the attachment portion itself is displaced relative to the mounting portion in a direction corresponding to direction A2 depicted in FIG. 4B. However, regardless of which component is held stationary it is the slide member that is selectively moveable between the home and release position. In the depicted embodiment, the slide member 180 is positioned closer to the position member when in the home position and further from the position member when in the release position. The slide member 180 is biased toward the home position by an applied biasing force directed toward the home position provided by a biasing element such as a spring or other suitable construction. While the presently disclosed embodiments depict a release position that is further away from the position member than the home position, embodiments in which the slide member 180 is located closer to the position member 178 in the release position than in the home position are also envisioned.

As depicted in FIG. 4A, the support channel 150 includes a first opening 151 and the position channel 130 includes a second opening 131. In the current embodiment, the distance between the first opening 151 and second opening 131 is greater than the distance between the slide member 180 and position member 178 when the slide member 180 is in the home position. Additionally, the distance between the first opening 151 and second opening 131 is less than the distance between the slide member 180 and position member 178 when the slide member 180 is in the release position. Therefore, when aligned with the corresponding channels, the slide member 180 and position member 178 may be selectively retained in the corresponding support channel 150 and position channel 130 when the slide member 180 is in the home position, and may be selectively released when the slide member 180 is in the release position.

Referring to FIGS. 4A and 4B, an exemplary procedure for attaching the attachment portion 174 to the mounting portion 160 is described. Slide member 180 is inserted into opening 151 and received in support channel 150. When positioned at the end of the channel, with the slide member 180 in the home position, the position member 178 is unable to enter opening 131 due to the distance between the position member 178 and slide member 180 being too short. Subsequently, slide member 180 is biased into the release position as the attachment portion 174 is moved in a direction A2 substantially toward the position channel 130. Once slide member 180 is biased into the release position, the distance between the slide member 180 and position member 178 is greater than the distance between openings 151 and 131. Subsequently, the attachment portion 174 may be pivoted about slide member 180 such that position member 178 is rotated into alignment with opening 131 of position channel 130. After placing the position member into alignment with the opening, the attachment portion is permitted to move in the reverse direction toward support channel 150 due to the biasing of slide member 180 toward the home position. This leads to a reduction in the distance between slide member 180 and position member 178 such that they are retained within support channel 150 and position channel 130 respectively. It is the selective retention of the slide member 180 and position member 178 within the associated channels that provides the selective attachment of the attachment portion 174 and mounting portion 160. To remove the attachment portion 174 from the mounting portion 160, the above-described process is reversed.

Figure 4C:
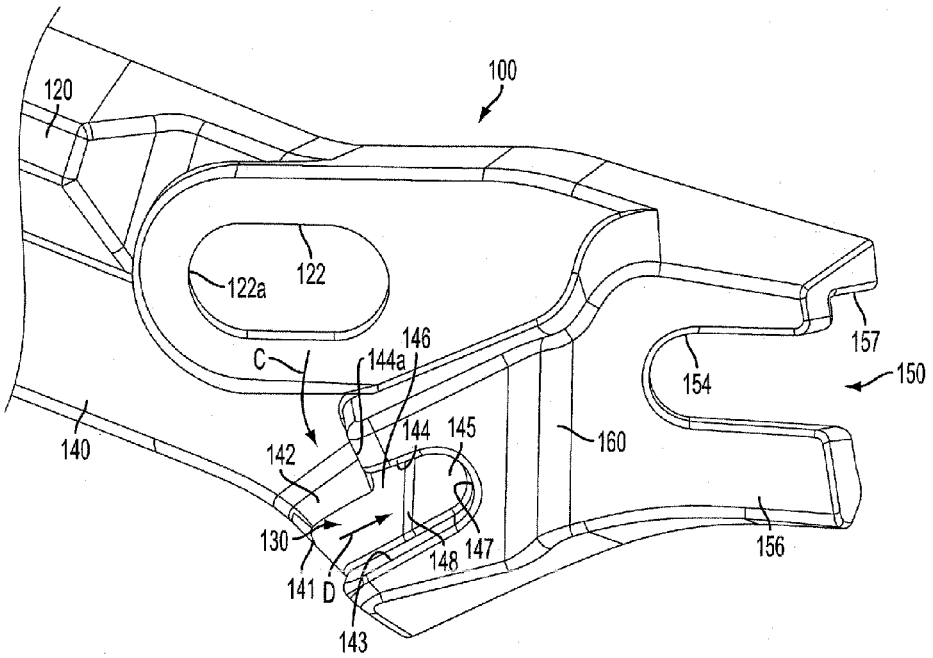
FIG. 4C is an exterior side view of a mounting portion.
Figure 4D:
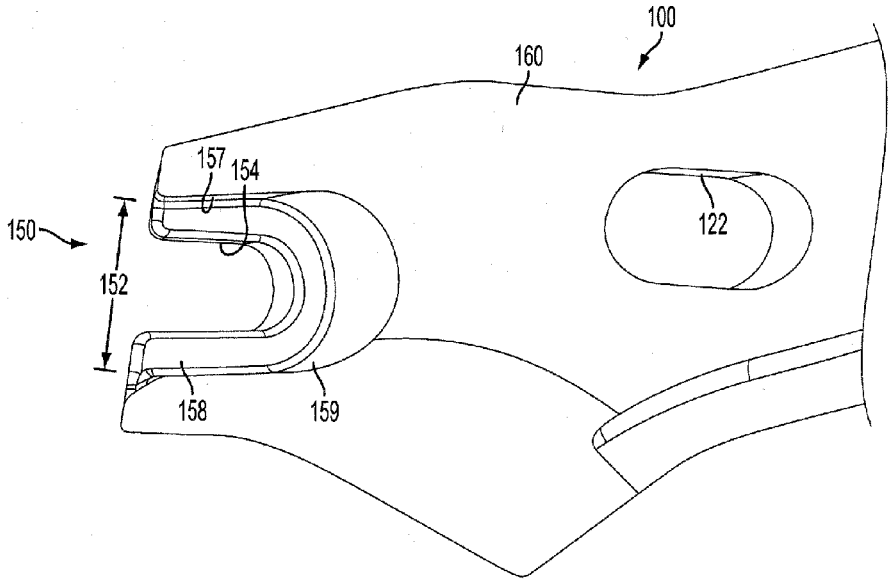
FIG. 4D is an interior side view of a mounting portion.

Turning now to a more detailed description of the mounting portion, FIGS. 4C and 4D show an enlarged perspective view of one particular embodiment of an end region of helmet rail 100 corresponding to mounting portion 160 of the helmet accessory attachment system. Support channels 150 (right side not shown) are provided on mounting portions 160 at opposite ends of the helmet rail 100 adjacent to the mounting slots 122. The two separate support channels 150 comprise a front surface 156 having a U-shaped slot 154. Behind the front surface 156 is a first rearward extending wall 157, and a second opposite rearward extending wall 159 forming a receiving channel 152 with a shelf 158. The receiving channel and shelf retain the sliding member while permitting the sliding member to slide therein.

In the depicted embodiment, position channels 130 are provided between the support channel and the inner most edge 122*a* of the mounting slot opening on each lateral side of the helmet rail 100. The position channel 130 has a lower wall 143, an opposite upper wall 144 creating a u-shaped formation 147. The floor of the position channel 130 has a first outer floor portion 146 and an inner floor portion 145 adjacent the base 174 of the u-shaped formation. The first outer floor portion is recessed to a position behind the inner floor portion with a transition 148 connecting the outer floor portion to the inner floor portion. The length of the lower wall 143 is longer than the upper wall 144. A sloping downward portion 142 joins with the outer floor portion 146 in an area opposite the lower wall 143 where the upper wall 144 does not extend. The shortened upper wall allows the position boss 215 to rotate upwards moving forward out of the u-shaped formation sufficient to clear the upper wall 144. Similar to support channels 150, position channels 130 include a receiving channel and corresponding shelf, not depicted, to retain the position member while permitting it to slide therein.

While the support channels and corresponding position channels have been depicted as being oriented at approximately a 45° angle relative to each other, other orientations are also possible. For example, the channels could be oriented substantially parallel, at approximately 90°, or any other suitable orientation and configuration that would permit the slide member and position member to be selectively retained therein.

In reference to FIGS. 1-4D, the selective attachment and removal of an accessory coupled to two helmet accessory attachment systems is described. Specifically, the attachment of a mandible guard incorporating two attachment arms with separate attachment portions to helmet rail 100 is described. When it is desired to attach the mandible guard to the helmet, slide members 180 present on the attachment portion of each attachment arm are substantially simultaneously slid into the corresponding support channels 150 with the position members 178 positioned above the position channels 130. The mandible guard is then drawn forward, which causes the base plate 172 and associated attachment portion 174 to move forward in the direction A2 relative to the slide members 180, which are held stationary at the back of the support channels 150. The attachment portions 174 are drawn fully forward so that the slide members 180 are in the release position. In the release position, the position members 178 are sufficiently forward of the forward end of the upper wall 144 of the position channel 130 to allow the position members 178 to be lowered, in the direction C as shown in FIG. 4C, into alignment with the position channel 130. The portion of the lower wall 143 that extends beyond the upper wall 144 provides a floor below which the position member does not travel and will guide the position member into the position channel. Once the upper most portion of the position members 178 are positioned below the upper wall 144, the biasing force applied to the slide members is permitted to draw the position members 178 in the direction D shown in FIG. 4C. The position member is drawn inwardly until the position member is adjacent to or against the back of the position channel and/or until the slide member reaches the home position. Once the position members 178 are seated within the position channels, the attachment arms 200 and the mandible guard are secured in place. In some instances, additional support may be provided by components that interact with a bottom edge of the helmet when the slide members and position members are retained in the corresponding channels.

To remove the mandible guard, the mounting procedure is reversed. The mandible guard and attachment arm 200 are pulled forward to draw the position members 178 clear of the upper wall 144 of the position channel by overcoming the biasing force of the biasing element. The mandible guard and attachment arms 200 are then pivoted upward causing the position members to correspondingly move upward in a direction opposite that of direction C shown in FIG. 4C along front wall 144*a*. Once the position members clear the top of the front wall 144*a*, the mandible guard and attachment arms can be drawn rearward to remove slide members 180 from support channels 150, thus detaching the attachment portions from the corresponding mounting portions on the helmet.

Figure 5A:
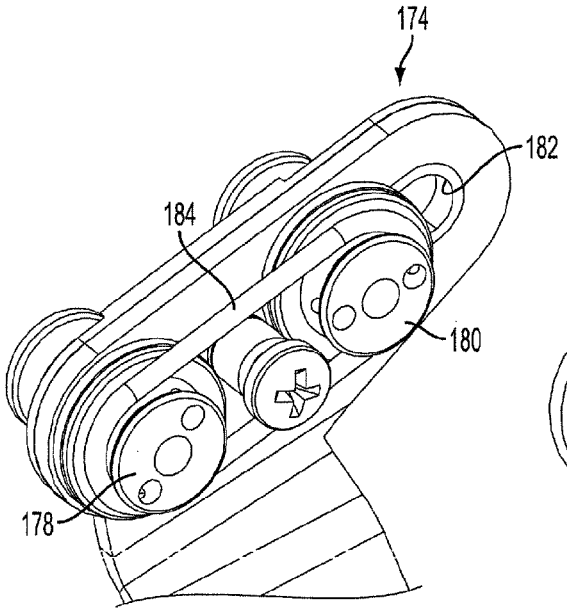
FIG. 5A is an exterior perspective of an attachment portion.
Figure 5B:
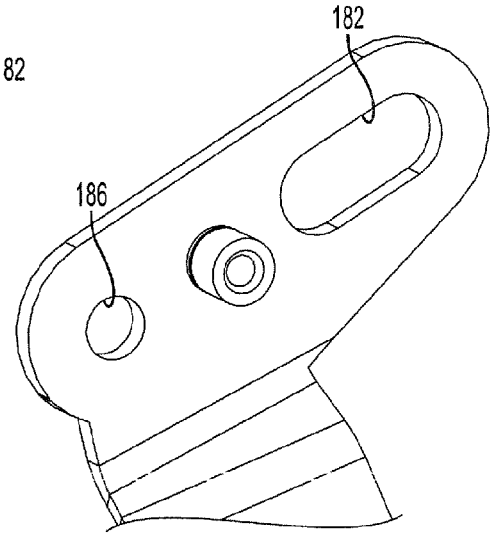
FIG. 5B is a perspective view of the base plate.
Figure 5C:
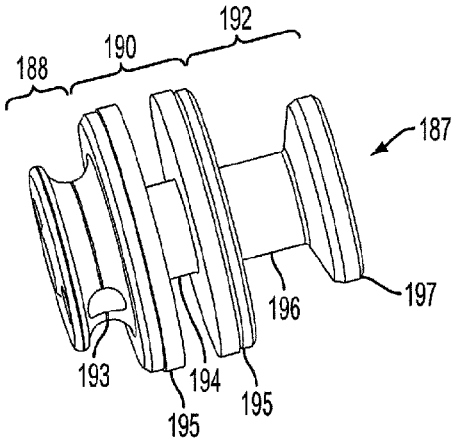
FIG. 5C is a perspective view of a slide member.

FIGS. 5A-5C present one embodiment of the attachment portion. In the depicted embodiment, an attachment portion 174 includes a slide member 180 slidingly received in slot 182 and a position member 178 attached at through hole 186. While an oblong oval shape for the slot has been depicted, any suitable shape could be used to provide the desired sliding motion including, for example, arcs, rectangles, and any other suitable shape. Accordingly, the associated slide member may be linearly movable or nonlinearly movable. It should be noted, that position member 178 is stationary relative to the attachment portion 174. Furthermore, the position member 178 may be attached to the attachment portion using any suitable means including, but not limited to, the depicted through hole, a threaded connection, a bolted connection, and other suitable methods. Alternatively, in some instances, the position member may be a boss, or similar feature, that is integrally formed with, or attached to, the attachment portion.

In addition to including a slide member and position member, the attachment portion 174 also includes a biasing element 184 for applying a biasing force to the slide member. In the current embodiment, the biasing element includes a resilient ring, such as an O-ring that is attached to both the slide member 180 and position member 178. When the slide member is drawn outwards toward the release position the resilient ring is deformed resulting in a biasing force being applied to both the slide member 180 and position member 178. Since the position member is fixed relative to the attachment portion, the slide member 180 is drawn toward the position member and the corresponding home position. While the resilient ring has been depicted as being attached to both the position member and slide member, it should be understood that the resilient ring could have been attached to the slide member and another suitable feature to provide the desired biasing force upon movement of the slide member toward the release position. Depending on the orientation of the corresponding channels on the mounting portion, in some embodiments, the home position may be located further away, or in a different orientation, from the position member than depicted in the figures. In such an embodiment, the biasing element would be constructed and arranged to bias the slide member away from the position member.

FIG. 5C presents a perspective view of pin 187 corresponding to slide member 180 and position member 178 of the current embodiment. Pin 187 includes a biasing element engaging portion 188, a slot engaging portion 190, and a mount engaging portion 192. The biasing element engaging portion 188 is adapted and configured to retain the disclosed resilient ring. Specifically, the biasing element engaging portion 188 includes a groove 193 shaped and sized to fit the corresponding resilient ring or another suitable biasing element. Groove 193 is present on both the slide member and position member. The slot engaging portion 190 includes retention features 195 on either side of shaft 194 that are sized and shaped to retain the pin in the corresponding through hole or slot. The slot engaging portion 190 may be assembled onto the attachment portion using any suitable connection method including, but not limited to, a press fit connection, a rivet connection, a threaded connection, a welded connection, a brazed connection, and any other suitable connection. The above noted connection may be made between portions of shaft 194 or between shaft 194 and at least one of the retention features 195. While a specific construction has been depicted, slot engaging portion 190 may be configured in any number of ways to be retained in through hole 186 and slidingly retained in slot 182. The mount engaging portion 192 is configured and adapted to be slidingly retained in the support and position channels present on the mounting portion of the helmet accessory attachment system. Specifically, in the current embodiment, a shaft 196 is sized to fit within the corresponding channels and a pinhead 197 is provided at the end of shaft 196 to prevent the pin from being removed from the corresponding channel in an undesired direction.

Figure 6:
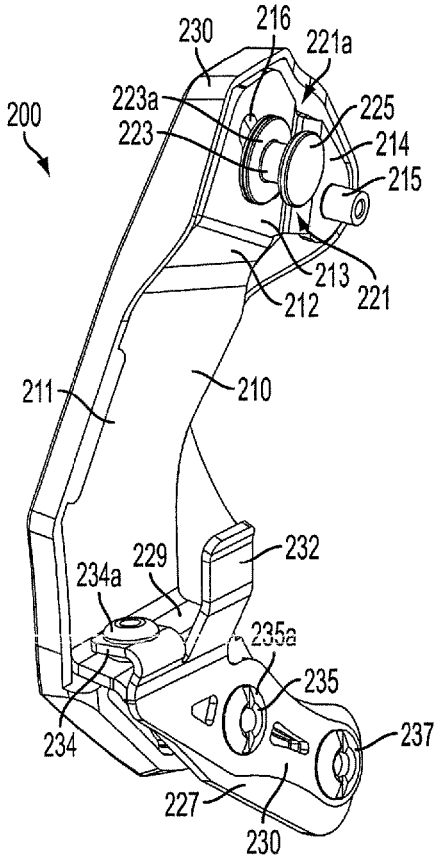
FIG. 6 is an interior perspective view of an attachment arm and associated attachment portion.
Figure 6A:
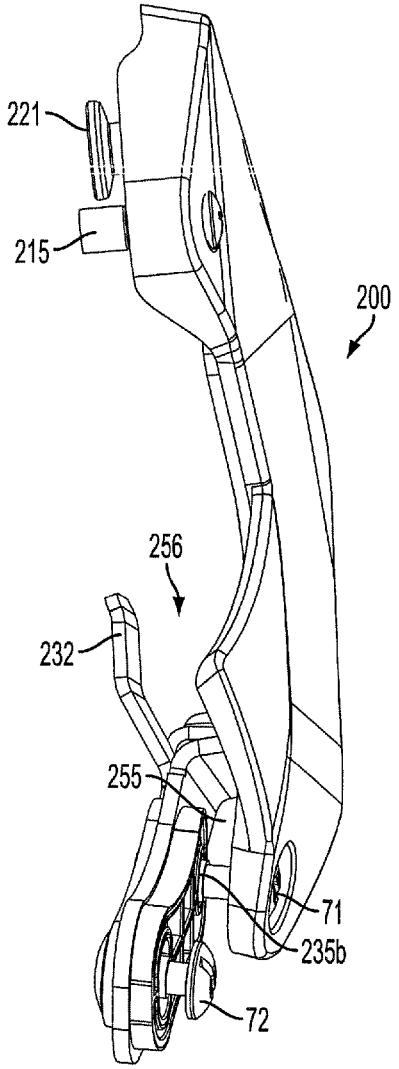
FIG. 6A is a side perspective view of the attachment arm of FIG. 6.
Figure 7:
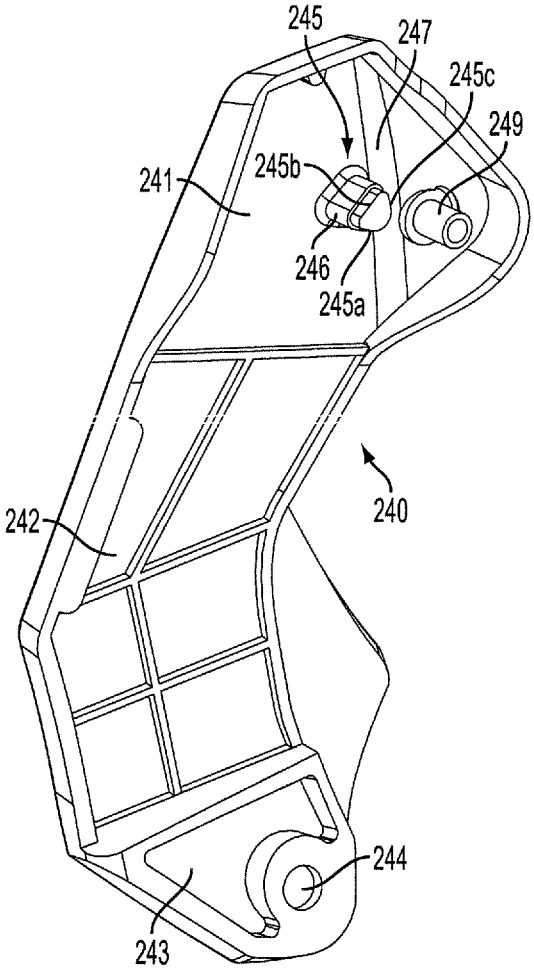
FIG. 7 is an interior perspective view of a body of the attachment arm of FIG. 6.

Another embodiment in which the attachment portion is incorporated into an attachment arm 200 is shown in detail in FIGS. 6-10. The attachment arm 200 has a body 240, a base plate 210, and a lower brace 230. As shown in FIG. 6, the base plate 210 fits at least partially within the body 240. The attachment arm 200 is configured to conform at least partially to the shape of the helmet 34, depicted in FIGS. 1-3, and more specifically to the ear cup 39 of the helmet 34. The ear cup 39 curves outward along a curved portion 37 away from a main body 40 of the helmet to provide additional space to accommodate a wearer's ear. The body 240 of the attachment arm 200 has a body upper portion 241, a body mid portion 242, and a body lower portion 243. The base plate 210 has a base upper portion 213, a base outward curved portion 212, a base mid portion 211 and the base bottom portion 227. The base outward curved portion 212 extends outwardly to accommodate at least a portion of the curvature of the curved portion 37 of the ear cup 39 so as to create a close conformity of the attachment arm 200 to the helmet including the ear cup along the relevant portions of the helmet.

The body is secured to the base plate at the top by an upper fastener, such as a bolt 73 that extends through an upper opening in line with an upper body boss 249 of the body and into the position boss 215 of the base that is aligned there with. The body is secured to the base plate at the bottom by a lower fastener, such as bolt 71 that extends through a lower opening 244. Both the upper body boss 249 and the lower opening 244 each have countersunk recesses (not shown) on the front surface of the body to recess the fastener head from the outer surface of the body.

The base upper portion 213 has a base forward extending portion 214, which comprises a position member in the form of position boss 215. The base upper portion 213 has an oblong slot 216. The oblong slot 216 extends generally upward from a forward end 216*a* of the oblong slot to a rear end 216*b* of the oblong slot. A slide member is operatively coupled with the oblong slot 216. Specifically, the slide member, e.g. slide pin 221, includes portions connected through the oblong slot 216 such that it is retained within the slot and is able to slide there in. Specifically, the slide pin 221 comprises an engaging portion 221*a* positioned on the backside of the base plate 210, and a spring engaging portion 221*c* position on the front side of the base plate 210. The mount engaging portion 221*a* comprises a pinhead 225, a first shaft 223, and a fixed washer 223*a*. The pinhead 225 is connected at the end of the shaft 223. A second shaft 223*e* extends through the oblong slot 216. The first shaft and second shaft are co-axial. The first shaft has a larger diameter than the second shaft. In some embodiments, the first and second shafts are formed from a unitary piece of material.

The fixed washer 223*a* may be fixed to the shaft 223 and located on the backside of the base plate. The fixed washer prevents the shaft from traveling into the oblong slot and ensures that there is a sufficient length of shaft 223 to fit into the U-shaped slot 154 of the support channel 150 so that the pinhead 225 is received in the head receiving channel 152. On the back side of the fixed washer 223*a* is a first flat watcher 223*c* that is designed to contact the base upper portion 213 about the oblong slot 216 on the backside. On the opposite front side of the base is a second flat watcher 223*b* that is configured to contact the base upper portion 213 about the oblong slot 216 on the front side. The spring retainer 224 abuts the second flat washer 223*b*. The spring retainer 224 has an outer portion 224*a* and a reduced portion corresponding to 224*b* and 224*c*. The reduced portion comprises a first portion 224*b* configured to be adjacent to and abut the second flat washer and an angled portion 224*c* between the first portion 224*b* and the outer portion 224*a*. The reduced portions 224*b* and 224*c* have a radius that is less than that of the outer portion. The spring 228 is configured to be received within the reduced portion between the second flat washer and the outer portion 224*a*. The area of the second shaft 223*e* that is between the first flat washer 223*c* and the second flat watcher 223*b* is the portion of the second shaft that operates within the oblong slot 216.

The spring retainer 224 is press fitted or alternatively bolted onto a threaded end 223*d* of the second shaft 223*e*. The end 223*d* of shaft 223 receiving the spring retainer may have a reduced radius that corresponds to a reduced radius portion of the bore of the spring retainer as compared to a remainder of the second shaft 223*e*.

Adjacent the forward end 216*a* of oblong slot 216 is a spring post opening 226. Spring post opening 226 has a generally triangular shape that corresponds to the shape and size of the second portion 246 of spring post 245 that is attached to the body upper portion of body 240. When body 240 is attached to base plate 210 the second portion 246 of spring post 245 protrudes into and through at least a portion of spring post opening 226 to secure it in position between spring 228. Spring post opening 226 and the corresponding spring post 245 is positioned so that the generally triangular shape has a flat side adjacent to the forward end 216*a* of oblong slot 216. The two remaining sides of the generally triangular shape extend forward as contact surfaces for engaging portions of spring 228.

Figure 9:
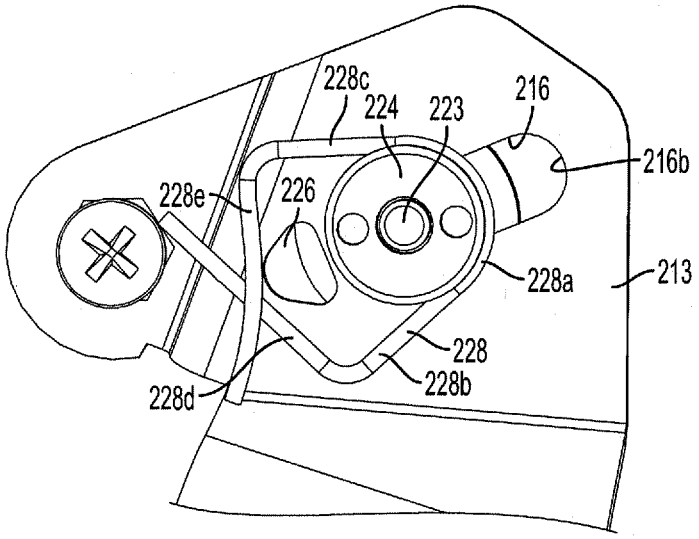
FIG. 9 is an exterior side view of the attachment portion of FIG. 6, where the slide member is in a home position.
Figure 10:
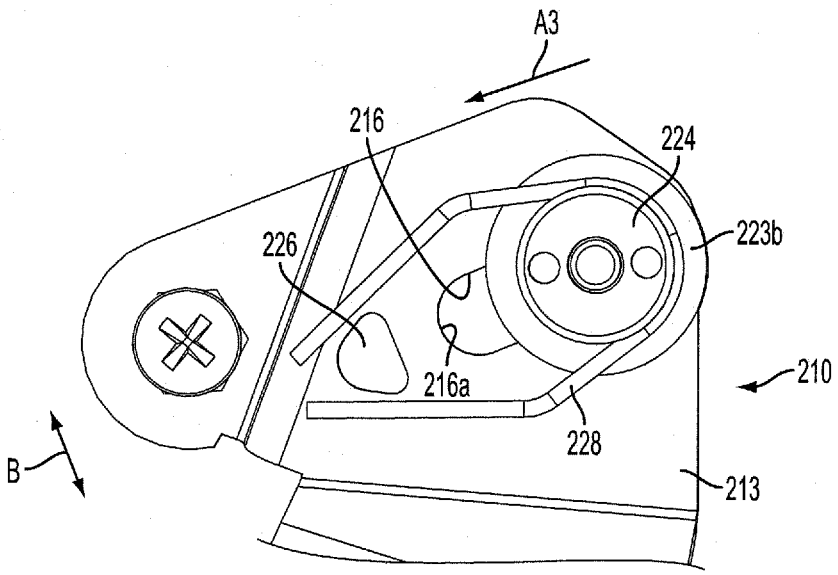
FIG. 10 is an exterior side view of an attachment portion of FIG. 6, where the slide member is in a release position.
Figure 11:
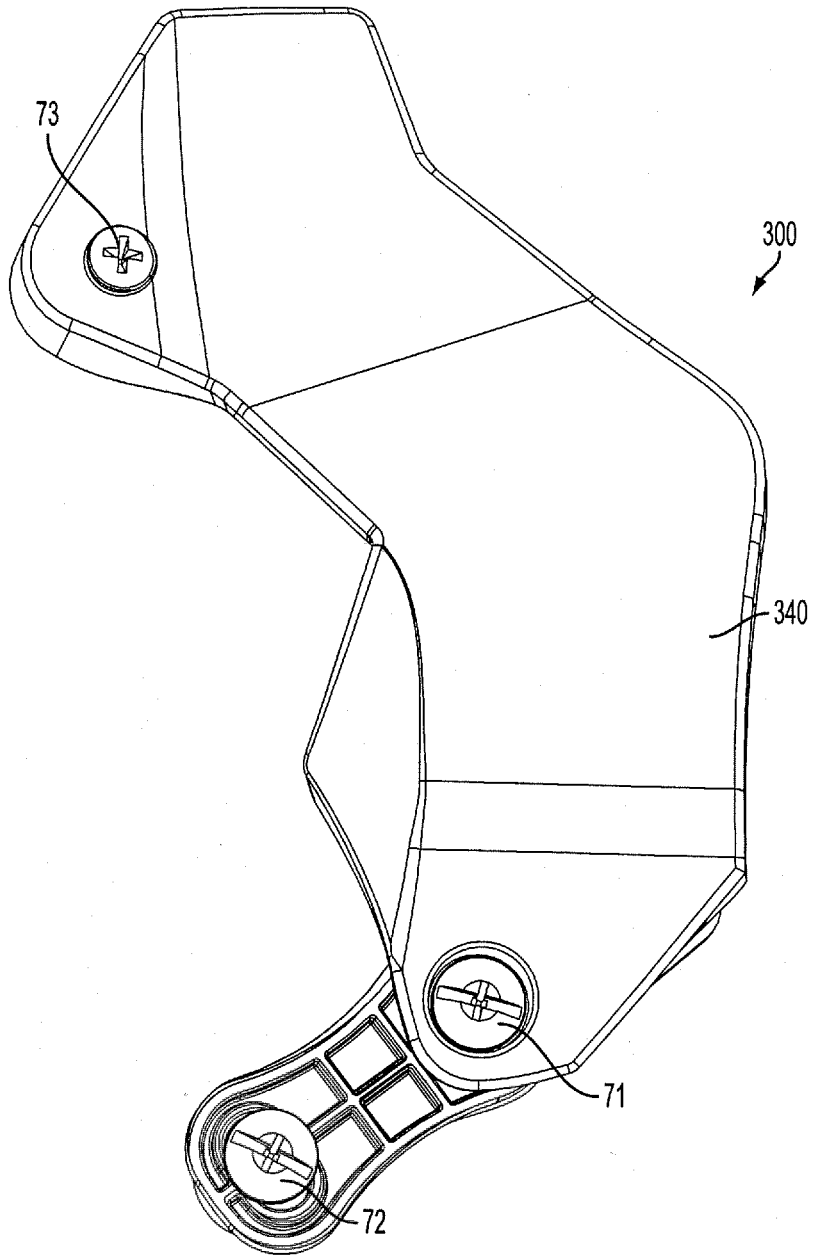
FIG. 11 is an exterior side view of a second embodiment of the attachment arm.
Figure 16:
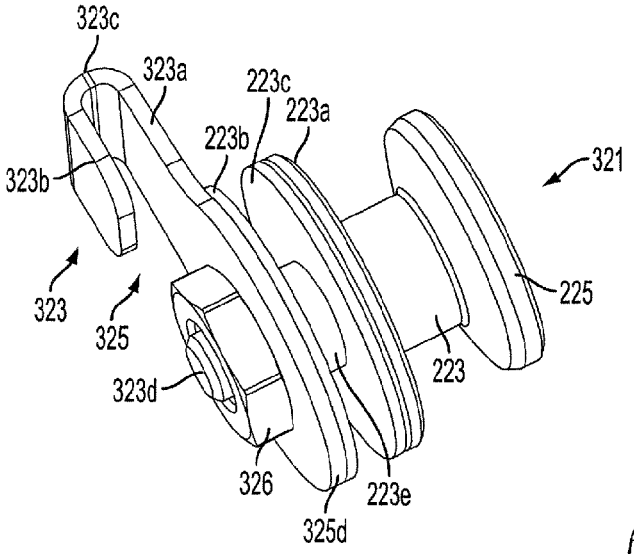
FIG. 16 is a perspective side view of a slide member of the attachment arm of FIG. 11.

As shown in FIGS. 9 and 10, the spring and the slide pin each have at least two positions relative to the base. FIG. 9 shows the slide pin in the home position relative to the base where the pin is adjacent or in contact with the forward end 216*a* of the oblong slot 216. FIG. 10 shows the slide pin in the release position relative to the base where the pin is adjacent or in contact with the rear end 216*b* of the oblong slot. In the home position the spring retainer 224 is closer to the spring post 245 then it is when the slide pin is in the release position.

The spring 228 can be described as having a number of portions including a u-shaped portion 228*a*, retainer flanking portions 228*b* and 228*c* extending from the U-shaped portion 228*a* in an outward direction, and inwardly biased portions 228*d* and 228*e* that generally are biased to extend inwardly relative to the retainer flanking portions. The inwardly-biased portions 228*d* and 228*e* cross over each other as shown in FIG. 9 when the base is in the home position. When the base is in the release position as shown in FIG. 10, the spring post 245 has been forced forward and has driven the inwardly biased portions 228*d* and 228*e* apart. The forwardly angled portions 245*a* and 245*b* of the spring post provide a surface, which in combination with the inwardly-biased portions 228*d* and 228*e* of the spring 228 bias or draw the slide pin 221 forward in the direction A3 of FIG. 10 and the base upper portion 213 rearward. If the slide pin is fixed in position by another component, such as the support channel 150, then the spring biases the base plate 210 and the attachment arm rearward in the direction opposite direction A3. When the base plate 210 is moved in the direction A3, the spring post 245 causes the inwardly biased portions 228*d* and 228*e* to expand outward in the direction B.

Figure 8A:
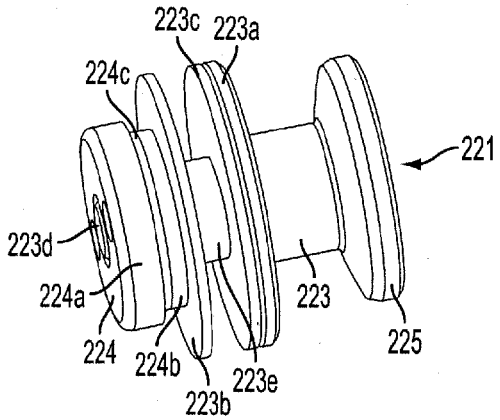
FIG. 8A is a perspective view of a slide member of the attachment arm of FIG. 6.
Figure 8:
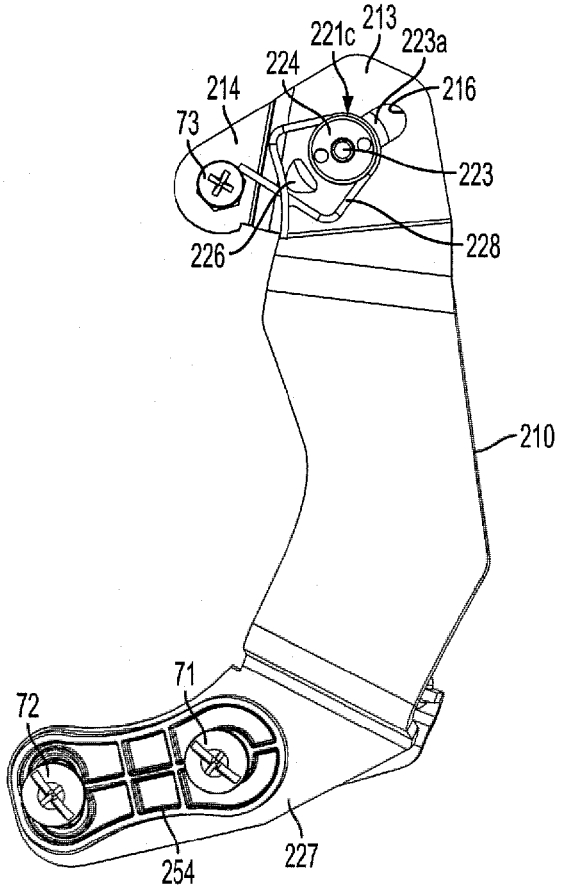
FIG. 8 is an exterior side view of a base of the attachment arm of FIG. 6.

As shown in FIG. 6, the base plate 210 has a ledge 229 connecting the base mid portion 211 of the base plate to the base plate bottom portion 227. The base plate bottom portion 227 is offset inwardly from the base mid portion 211. This allows at least a portion of the mandible guard 36 to be secured in the gap 255 between the back surface of the body lower portion 243 and the base plate bottom portion 227 by the bolt 71. In some embodiments, as shown in FIG. 8, a shim 254 may be provided between the base plate bottom portion and the mandible guard to adjust the alignment of the mandible guard. The bolt 71 is received in a threaded boss 235. The boss has a base 235*a* and a hollow threaded receiving bore 235*b*. The base is wider than the hollow threaded receiving bore 235*b* to which it is connected. Boss 237 is identical to boss 235. Bolt 72 secures the mandible guard to the lower brace 230 and base plate bottom portion 227 when engaged with boss 237.

The lower brace 230 has two holes (not shown), through which a shaft of each boss 235 and 237 extends, respectively. A base of each boss is configured to be pulled against the lower brace 230. When the bolts 71 and 72 are threaded into the bosses 235 and 237 the lower brace is secured against the base plate bottom portion 227. A first arm 234 of the lower brace 230 lays against the ledge 229 of the base plate for support and may have a rivet 234*a* to buffer contact between the lower brace 230 and the ledge 229 and/or between the brace and the helmet edge 35. A second arm 232 extends upwardly and creates a u-shaped cradle 256 that is configured to receive a portion of the edge 35 of the helmet, as shown in FIG. 1. The position of the u-shaped cradle 256 around the helmet edge prevents lateral movement of the mandible guard.

To attach or mount the mandible guard via the attachment arms to the helmet mount 100, the slide pins 221 are substantially simultaneously slid into the corresponding support channels 150 with the position bosses 215 positioned above the position channels 130. The mandible guard is then drawn forward, which causes the base upper portion 213 base plate 210 to move forward in the direction A3 noted in FIG. 10 moving the slide pins 221 of the attachment portion into the release position since it is held stationary at the back of the support channels 150. The base upper portion 213 is drawn fully forward so that the slide pin is in the release position. In the release position, the position bosses 215 are sufficiently forward of the forward end of the upper wall 144 of the position channel 130 to allow the position bosses 215 to be lowered, in the direction C as shown in FIG. 4C, into the position channel 130. Once the upper most portion of the position bosses 215 are positioned below the upper wall 144 the bias of the spring 280 against the spring post 245 draws the position bosses 215 in the direction D shown in FIG. 4C adjacent to or against the base 174 of the position channel as the base upper portion 213 is drawn in the direction opposite the direction A3 in FIG. 10 until the home position shown in FIG. 9 is reached. The portion of the lower wall 143 that extends beyond the upper wall 144 provides a floor below which the position boss does not travel and a guide into the position channel. When position bosses 215 are seated within the position channels the attachment arms 200 and the mandible guard are secured in place by a triangular support configuration provided by the position bosses within the position channel, the slide pins 221 within the support channels 150, and the helmet edge 35 received within U-shaped cradle 256 between the second arm 232, the first arm 234 and the base mid portion 211 of the base plate 210.

To remove the mandible guard, the mounting procedure is reversed. Specifically, the mandible guard and attachment arm 200 are pulled forward to draw the position bosses 215 clear of the upper wall 144 of the position channel overcoming the bias of the spring 280 by drawing the base upper portion 213 forward in the direction A of FIG. 10. Then the mandible guard and the attachment arms 200 are pivoted upward causing the position bosses to move upward in the direction opposite of direction C in FIG. 4 along a front wall 144*a*. During the upward pivot the U-shaped cradle 256 withdraws from the helmet edge 35. Once the position bosses clear the top of the front wall 144*a*, the mandible guard and attachment arms can be drawn rearward to remove the slide pins 221 from the support channels 150, thus removing the mandible guard from the helmet.

Figure 12:
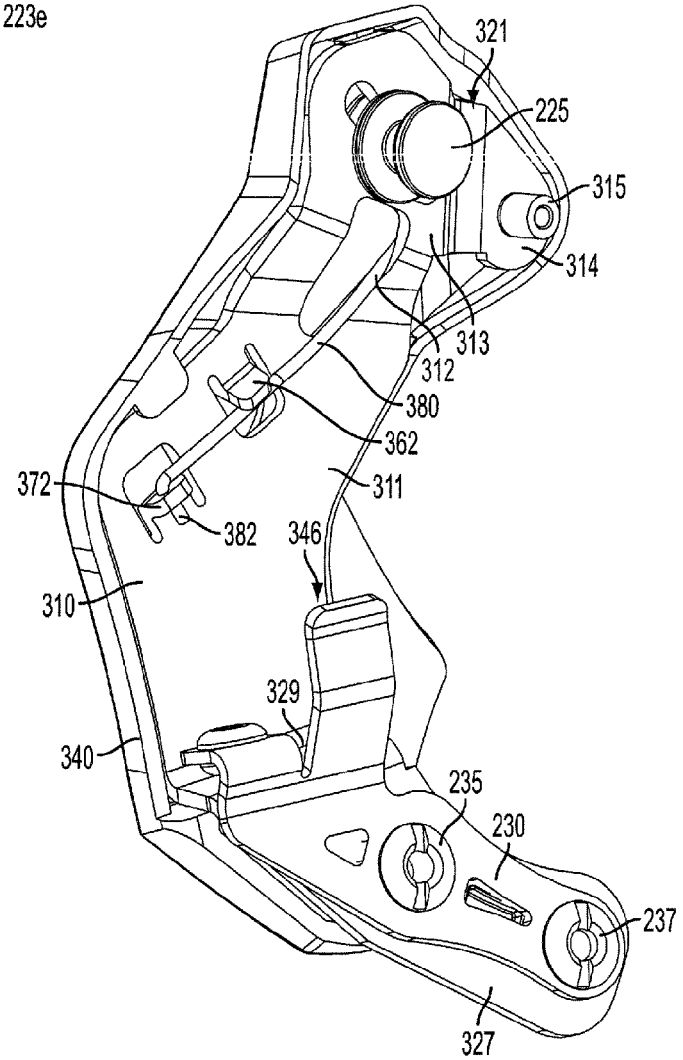
FIG. 12 is an interior perspective view of the attachment arm of FIG. 11.
Figure 13:
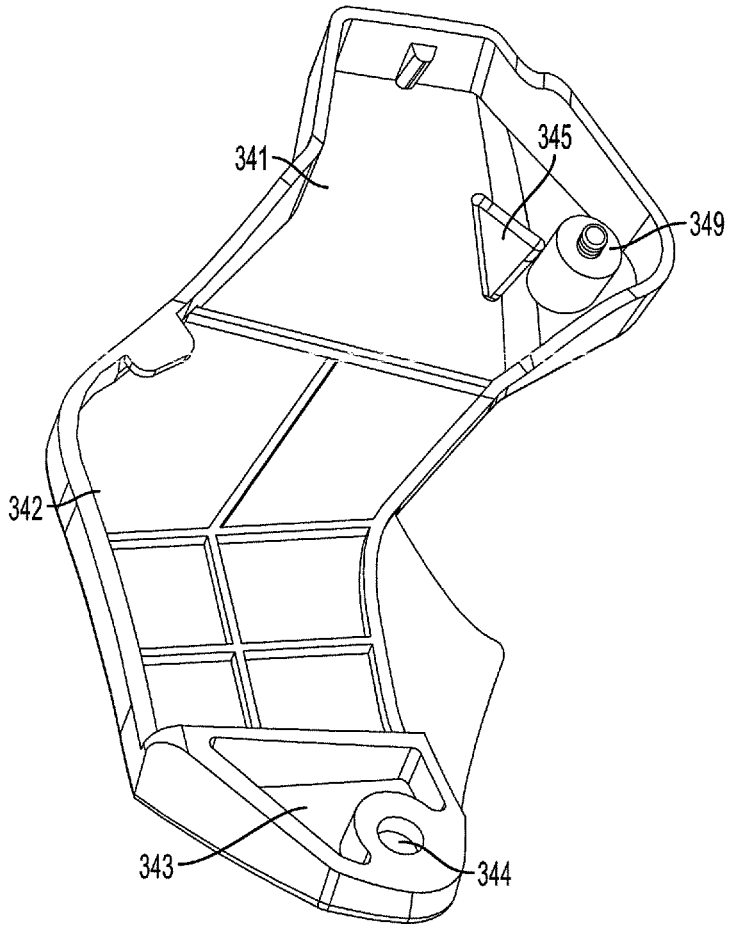
FIG. 13 is an interior perspective view of a body of the attachment arm of FIG. 11.
Figure 14:
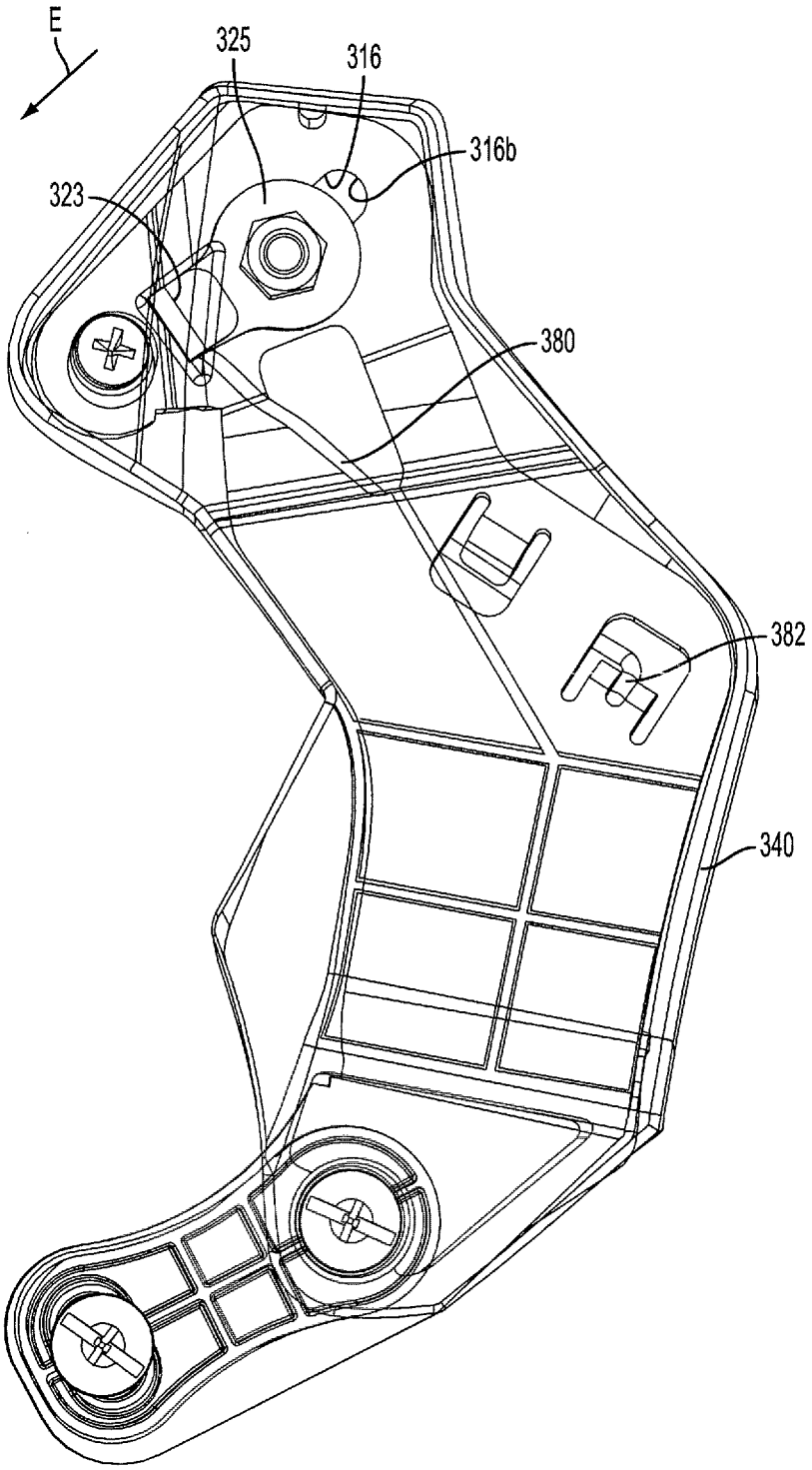
FIG. 14 is an exterior side view of the attachment arm of FIG. 11 with the body shown transparently.
Figure 15:
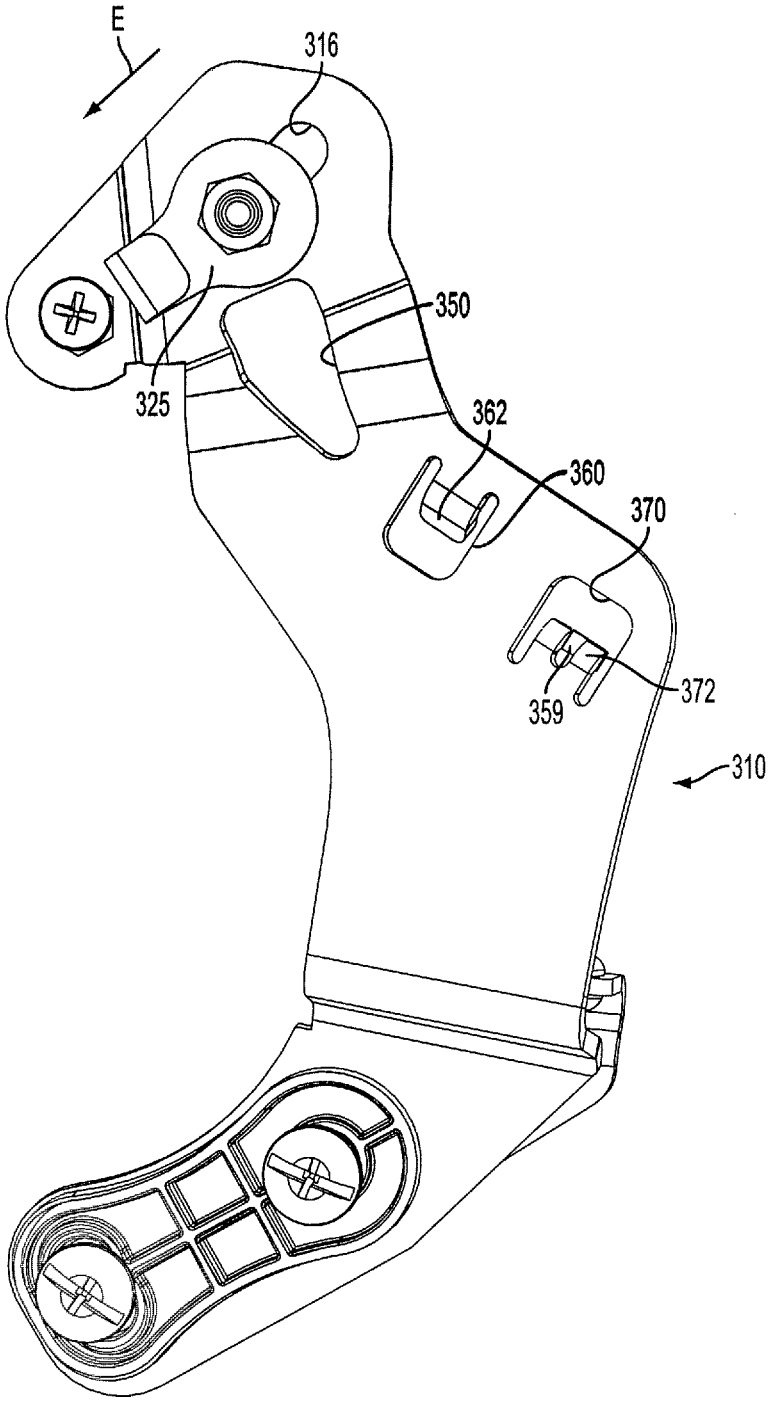
FIG. 15 is an interior side view of a base of the attachment arm of FIG. 11.

Yet another embodiment of an attachment arm 300 is depicted in FIGS. 11-16. The attachment arm 300 has a body 340, a base plate 310, and a lower brace 230. As shown in FIG. 12, the base plate 310 fits at least partially within the body 340. The attachment arm 300 is configured to conform at least partially to the shape of the helmet 34 and more specifically to the ear cup 39 of the helmet 34. The body 340 of the attachment arm 200 has a body upper portion 341, a body mid portion 342, and a body lower portion 343. The base plate 310 has a base upper portion 313, a base outward curved portion 312, a base mid portion 311 and a base lower portion 327. The base outward curved portion 212 extends outwardly to accommodate at least a portion of the curvature of the curved portion 37 of the ear cup 39 so as to create a close conformity of the attachment arm 200 to the helmet including the ear cup along the relevant portions of the helmet. The body upper portion has a spring cradle recess 345 to accommodate the protrusion of the spring cradle 325.

The base plate is secured to the body at the top by an upper fastener, such as a bolt 73 that extends through an upper opening in line with an upper body boss 349 of the body and into a position member corresponding to position boss 315 of the base that is aligned therewith. The body is secured to the base plate at the bottom by a lower fastener, such as bolt 71 that extends through a lower opening 344. Both the upper opening 306 and the lower opening 344 each have countersunk recesses (not shown) to recess the fastener head from the outer surface of the body.

The base upper portion 313 has a base forward extending portion 314, which comprises the position boss 315. The base upper portion 313 has an oblong slot 316. The oblong slot 316 extends generally upward from a forward end 216*a* of the oblong slot to a rear end 216*b* of the oblong slot. A slide member corresponding to slide pin 321 is disposed through the oblong slot 316. The slide pin 321 is identical to slide pin 221 except that the spring retainer 224 of the slide pin 221 is removed and replaced with a spring cradle 325 and a locking nut 326. The spring cradle comprises a circular body 325*d*, and a u-shaped arm 323. The u-shaped arm has parallel sides 322*a*, 322*b* that are joined at a base 323*c*. The spring cradle 325 abuts the second flat washer 223*b*. The locking nut 326 mates with a threaded end 323*d* of the second shaft 223*e* and secures the spring cradle 325 against the second flat washer 223*b*.

The base plate 310 has a number of openings 350, 360, 370 extending through the base upper portion 313, the base outward curved portion 312, and the base mid portion 311. The spring transverse opening 350 allows the spring 380 to pass from the front side of the base plate to the back side of the base plate. The spring 380 is biased to a linear orientation. The spring is generally linear when in a non-tensioned state and free from bending forces being applied to it. The spring has an L-end 382. The support opening 360 provides a support arm 362 extending laterally therefrom. The support arm 362 provides a fulcrum and guides and supports the spring 380. The end anchor opening 370 provides an end anchor ledge 372 extending laterally therefrom. The anchor ledge 372 has an anchor opening 359 for receiving the L-end 382 of the spring 380.

The L-end 382 of the spring 380 is anchored in the anchor formation 372. The spring 380 extends from the anchor formation 372 forward along the back face of the base plate 310, underneath the support arm 362, through the spring traverse opening 350, along a portion of the front side of the base plate, and into the U-shaped arm 323 of the spring cradle 325. When the base upper portion 313 of the base plate 310 is moved forward and the slide pin 321 is held stationary, bending tension is created in the spring 380 as the support arm 362 moves forward with the base plate 310 while the spring cradle 325 remains stationary and attached to the slide pin 321 in the support channel. The bending tension biases the base in a direction opposite direction E of FIG. 14 as slide pin 321 is biased toward the home position.

The slide pin 321 has a home position as shown in FIGS. 11-14, similar to that of base plate 210, and a release position (not shown). When in the released position the slide pin is positioned adjacent to against the rear end 316*b* of the oblong slot 316. The spring 380 biases the slide pin toward the home position. It will be understood that when the base plate moves relative to the slide pin, the attachment arms moves in sync with the base plate except that the slide pin may move within the oblong slot relative to the base plate.

As shown in FIG. 12, the base plate 320 has a ledge 329 connecting the base mid portion 311 of the base plate to the base plate bottom portion 327. The base plate bottom portion 327 is offset inwardly from the base mid portion 311. This allows at least a portion of the mandible guard 36 to be secured in the gap between the back surface of the lower body portion 343 and the base plate bottom portion 327 by the bolt 71. The lower brace 230 is usable with base plate 310. The mandible guard is secured to the attachment arm 300 in the same manner as the mandible guard is secured to attachment arm 200. The second arm 232 extends upwardly and creates a U-shaped cradle 346 that is configured to receive a portion of the edge 35 of the helmet, as shown in FIG. 1. The position of the u-shaped cradle 346 around the helmet edge prevents lateral movement of the mandible guard.

From the perspective of the user, the operation of the above embodiment of the helmet accessory attachment system is also similar to the operations described above with respect to attachment arms 170 and 200. To attach or mount the mandible guard, the slide pins 321 are substantially simultaneously slid into the corresponding support channels 150 with the position bosses 315 positioned above the position channels 130. The mandible guard is then drawn forward, which causes the base upper portion 313 of the base plate 310 to move forward in the direction E in FIGS. 14 and 15 so that the base upper portion moves forward relative to the slide pin 321, which is held stationary at the base of the support channels 150. The base upper portion 313 is drawn fully forward so that the slide pins 321 are in the release position. In the release position, the position bosses 315 are sufficiently forward of the forward end of the upper wall 144 of the position channel 130 to allow the position bosses 315 to be lowered via a pivoting motion, in the direction C as shown in FIG. 4, into the position channel 130. Once the upper most portion of the position bosses 315 are positioned below the upper wall 144, the bias of the spring 380 against the bending force at the support arm 362 and the anchor ledge 372 draws the position bosses 315 in the direction D shown in FIG. 4C adjacent to or against the base 174 of the position channel as the base upper portion 313 is drawn in the direction opposite the direction E in FIG. 14 until the slide pins reach their home positions. The portion of the lower wall 143 that extends beyond the upper wall 144 provides a floor below which the position boss does not travel and guides the position boss into the position channel. When position bosses 315 are seated within the position channels the attachment arms 300 and the mandible guard are secured in place with a triangular support configuration provided by the position bosses 315 within the position channels, the slide pin 321 within the support channels 150, and the helmet edge 35 received within a u-shaped cradle between the second arm 232, the first arm 234 and the base mid portion 311 of the base plate 310.

To remove the mandible guard, the mounting procedure is reversed. The mandible guard and attachment arms 300 are pulled forward in direction E of FIG. 14 to draw the position bosses 315 clear of the upper wall 144 of the position channel. Then the mandible guard and the attachment arms 300 are pivoted upward causing the position bosses to move upward in the direction opposite of direction C in FIG. 4 adjacent and along a front wall 144*a*. During the upward pivot the u-shaped cradle between the second arm 232, the first arm 234 and the base mid portion 311 withdraws from helmet edge 35. Once the position bosses clear the top of the front wall 144*a*, the mandible guard and attachment arms can be drawn rearward to remove the slide pins 321 from the support channels 150.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

The invention claimed is:

1. A helmet accessory attachment system comprising:

an attachment portion comprising a biasing element, a position member, and a movable member, the movable member being selectively movable between a home position which is a first distance from the position member, and a release position which is a second distance from the position member, wherein the biasing element biases the movable member toward the home position and toward the position member, and wherein the attachment portion includes an elongate slot, and a portion of the movable member is slidable in the elongate slot; and a mounting portion attachable to a helmet, wherein the mounting portion comprises a first channel to receive the movable member at a first opening and a second channel to receive the position member at a second opening, wherein a third distance between the first opening of the first channel and the second opening of the second channel is greater than the first distance from the movable member to the position member in the home position.

2. The helmet accessory attachment system of claim 1, wherein the third distance between the first opening of the first channel and the second opening of the second channel is less than the second distance.

3. The helmet accessory attachment system of claim 1, wherein the movable member is a slide member.

4. The helmet accessory attachment system of claim 1 wherein the system comprises a plurality of attachment portions and corresponding mounting portions.

5. The helmet accessory attachment system of claim 1, wherein the movable member is linearly movable.

6. The helmet accessory attachment system of claim 1, wherein the attachment portion is configured to selectively retain at least one accessory.

7. The helmet accessory attachment system of claim 3, further comprising at least one accessory, wherein the at least one accessory includes at least one of an illuminator, a camera, a video recorder, a laser pointer, a communications component, an IFF device, an attachment arm, a visor, a face shield, and goggles.

8. The helmet accessory attachment system of claim 3, further comprising at least one accessory, wherein the at least one accessory includes a mandible guard.

9. The helmet accessory attachment system of claim 1, wherein the movable member is pivotable within the first channel.

10. The helmet accessory attachment system of claim 1, wherein the first channel is oriented substantially parallel to, or in alignment with, the second channel.

11. The helmet accessory attachment system of claim 1, wherein the mounting portion is selectively attachable to a rail on the helmet.

12. The helmet accessory attachment system of claim 1, wherein the mounting portion is integrally formed with the helmet.

13. The helmet accessory attachment system of claim 1, wherein the biasing element comprises a resilient ring.

14. The helmet accessory attachment system of claim 1, wherein the biasing element comprises a spring.

15. The helmet accessory attachment system of claim 1, wherein the biasing element applies a force to the position member and movable member to bias the movable member toward the home position.

16. The helmet accessory attachment system of claim 1, further comprising the helmet, wherein the mounting portion is attached to the helmet.

17. A helmet accessory attachment system comprising:

an attachment portion comprising a biasing element, a position member, and a movable member selectively movable between a home position and a release position, wherein the biasing element biases the movable member toward the home position, and a distance between the position member and the movable member in the home position is different from a distance between the position member and the movable member in the release position wherein the attachment portion includes an elongate slot, and a portion of the movable member is slidable in the elongate slot; and a mounting portion attachable to a helmet, wherein the mounting portion comprises a first channel to receive the movable member, and a second channel to retain the position member with the movable member moved toward or in the home position and to release the position member when the movable member is in the release position.

18. The helmet accessory attachment system of claim 17, wherein the attachment portion is pivotable about the movable member when the movable member is positioned within the first channel.

19. The helmet accessory attachment system of claim 17, wherein the movable member is linearly movable.

20. The helmet accessory attachment system of claim 17, wherein the attachment portion is configured to selectively retain at least one accessory.

21. The helmet accessory attachment system of claim 20, wherein the at least one accessory includes a mandible guard.

22. The helmet accessory attachment system of claim 17, wherein the first channel is oriented substantially parallel to, or in alignment with, the second channel.

23. The helmet accessory attachment system of claim 17, wherein the biasing element comprises a resilient ring.

24. The helmet accessory attachment system of claim 17, wherein the first channel comprises a first opening and the second channel comprises a second opening, wherein a first distance between the first opening and second opening is greater than a second distance from the movable member to the position member in the home position.

25. The helmet accessory attachment system of claim 17, wherein the first channel comprises a first opening and the second channel comprises a second opening, wherein a first distance between the first opening and second opening is less than a second distance from the movable member to the position member in the release position.

26. A method of removably attaching an attachment portion to a mounting portion of a helmet, the attachment portion comprising a biasing element, a position member, an elongate slot, and a movable member selectively movable between a home position relative to the attachment portion and a release position relative to the attachment portion, wherein the biasing element biases the movable member toward the home position and toward the position member, the method comprising:

moving the movable member into a first channel of a mounting portion;

moving the movable member to the release position;

rotating the attachment portion to align the position member with a second channel of the mounting portion; and permitting the attachment portion to move toward the home position such that the position member is drawn into the second channel of the mounting portion as the movable member moves toward the home position and toward the position member by sliding along the elongate slot.

27. The method claim 26, wherein rotating the attachment portion comprises pivoting the attachment portion about the movable member.

28. The method of claim 26, further comprising:

moving the movable member to the release position such that the position member is removed from the second channel of the mounting portion;

rotating the attachment portion to take the position member out of alignment with the second channel of the mounting portion; and removing the movable member from the first channel of the mounting portion.

29. The method of claim 26, wherein the movable member comprises a slide member, and moving the movable member into a first channel of a mounting portion comprises sliding the slide member.

30. The method of claim 26, further comprising attaching an accessory to the attachment portion.

31. The method of claim 30, wherein attaching an accessory to the attachment portion further comprises attaching at least one of an illuminator, a camera, a video recorder, a laser pointer, a communications component, an IFF device, an attachment arm, a visor, a face shield, and goggles to the attachment portion.

32. The method of claim 26, wherein attaching an accessory to the attachment portion further comprises attaching at least a mandible guard to the attachment portion.

33. The method of claim 26, wherein moving the movable member to the release position further comprises moving the movable member to a first distance from the position member, wherein the first distance is greater than a second distance between a first opening of the first channel and a second opening of the second channel.

34. The method of claim 26, wherein releasing the attachment portion further comprises moving the movable member to a first distance from the position member, wherein the first distance is less than a second distance between a first opening of the first channel and a second opening of the second channel.

35. A helmet accessory attachment system comprising:

an accessory;

an attachment portion attachable to the accessory, wherein the attachment portion comprises a biasing element, a position member, and a movable member, the movable member being selectively movable between a home position and a release position, wherein the biasing element biases the movable member toward the home position, the attachment portion includes an elongate slot, and a portion of the movable member is slidable in the elongate slot, and a distance between the position member and the movable member in the home position is different from a distance between the position member and the movable member in the release position, and wherein the position member is retainable in a channel of a mounting portion with the movable member moved toward or in the home position, and releasable from the channel of the mounting portion with the movable member in the release position.

36. The helmet accessory attachment system of claim 35, wherein the accessory comprises a mandible guard.

37. The helmet accessory attachment system of claim 35, wherein the movable member is linearly movable.

38. The helmet accessory attachment system of claim 17, wherein the position member is closer to the movable member with the movable member in the home position than with the movable member in the release position.

39. The helmet accessory attachment system of claim 35, wherein the position member is closer to the movable member with the movable member in the home position than with the movable member in the release position.

40. The helmet accessory attachment system of claim 17, wherein the mounting portion is integrally formed with the helmet.

41. The helmet accessory attachment system of claim 17 wherein the biasing element comprises a spring.

42. The helmet accessory attachment system of claim 17, further comprising the helmet, wherein the mounting portion is attached to the helmet.

43. The method of claim 26, further comprising attaching the mounting portion to a helmet.

* * * * *